US006497219B2

(12) United States Patent
Natsume

(10) Patent No.: US 6,497,219 B2
(45) Date of Patent: Dec. 24, 2002

(54) COMMON RAIL FUEL INJECTION SYSTEM

(75) Inventor: Tetsushi Natsume, Anjo (JP)

(73) Assignee: Denso Corporation, Aichi (JP)

( * ) Notice: Subject to any disclaimer, the term of this patent is extended or adjusted under 35 U.S.C. 154(b) by 0 days.

(21) Appl. No.: 09/826,360

(22) Filed: Apr. 5, 2001

(65) Prior Publication Data

US 2001/0029929 A1 Oct. 18, 2001

(30) Foreign Application Priority Data

Apr. 13, 2000 (JP) ..... 2000-111520

(51) Int. Cl.[7] ..... F02M 55/02
(52) U.S. Cl. ..... 123/468; 123/469; 123/456
(58) Field of Search ..... 123/456, 447, 123/468, 469; 285/125.1, 333.4, 333.11, 189, 156, 155

(56) References Cited

U.S. PATENT DOCUMENTS

| | | | | |
|---|---|---|---|---|
| 5,120,084 A | * | 6/1992 | Hashimoto | 285/156 |
| 5,387,015 A | * | 2/1995 | Sisk | 285/55 |
| 5,551,733 A | * | 9/1996 | Henwood | 285/155 |
| 6,050,611 A | | 4/2000 | Asada | |

FOREIGN PATENT DOCUMENTS

| | | | |
|---|---|---|---|
| JP | 4-287866 | | 10/1992 |
| JP | 10-169527 | | 6/1998 |
| JP | 10-196869 | * | 7/1998 |
| JP | 10-246378 | * | 9/1998 |
| WO | WO 01/21955 | * | 3/2001 |

* cited by examiner

*Primary Examiner*—Willis R. Wolfe
*Assistant Examiner*—Mahmoud Gimie
(74) *Attorney, Agent, or Firm*—Nixon & Vanderhye PC

(57) ABSTRACT

A common rail housing for a common rail injection system is composed of a pressure accumulation pipe whose outer circumference is formed in complete round shape in cross section and which is provided inside with a pressure accumulation chamber having oval cross section and a plurality of blanch pipes each of which is provided inside with a fuel conduit bore. Outer circumference of the oval cross section has a specified portion whose curvature is smaller than that of complete round shape having an area equal to that of the oval cross section. Each of the blanch pipe is connected to the pressure accumulation pipe so that the fuel conduit bore and the pressure accumulation chamber intersect nearly perpendicularly to each other at the specified portion. Accordingly, when fuel is supplied to the pressure accumulation chamber, not only the stresses concentrated on the specified portion are limited but also wall strength of the pressure accumulation pipe at the specified portion is reinforced.

5 Claims, 5 Drawing Sheets

FIG. 7A
PRIOR ART
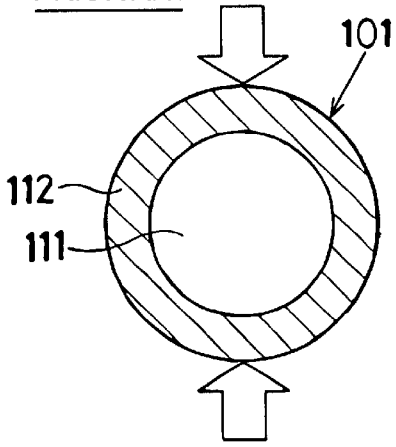
FIG. 7B
PRIOR ART
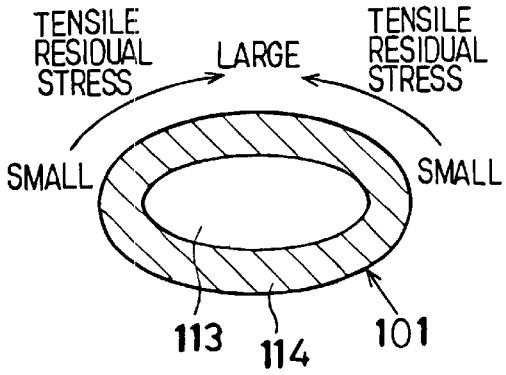
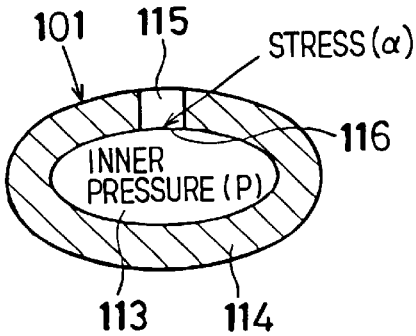
FIG. 7C
PRIOR ART
FIG. 8A
PRIOR ART
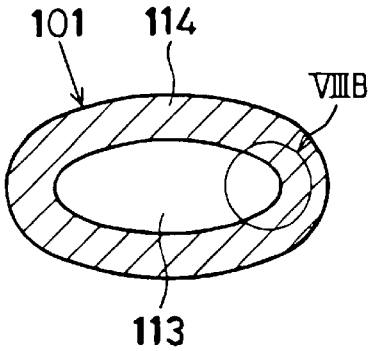
FIG. 8B
PRIOR ART
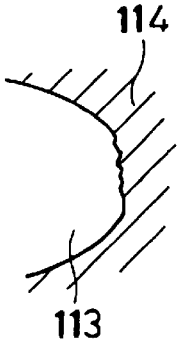

COMMON RAIL FUEL INJECTION SYSTEM

CROSS REFERENCE TO RELATED APPLICATION

This application is based upon and claims the benefit of priority of Japanese Patent Application No. 2000-111520 filed on Apr. 13, 2000, the content of which is incorporated herein by reference.

BACKGROUND OF THE INVENTION

1. Field of the Invention

The present invention relates to a common rail fuel injection system in which highly pressurized fuel accumulated in a pressure accumulation chamber of a common rail housing is supplied to injectors of an internal combustion engine, and in particular to the construction of the common rail housing.

2. Description of Related Art

A common rail fuel injection system as disclosed in JP-A-4-287866 is well known. The injection system has a common rail housing which acts as a kind of a surge tank and is provided with a pressure accumulation chamber extending in a lateral direction thereof. Highly pressurized fuel accumulated in the pressure accumulation chamber is supplied to injectors of an internal combustion engine.

In the conventional common rail system, as shown in FIG. 6, a common rail housing 101 is provided with a pressure accumulation chamber 102 in which highly pressurized fuel is temporally accumulated, a plurality of fuel supply ports (not shown) through which highly pressurized fuel delivered by a fuel supply pump is supplied to the pressure chamber 102, and a plurality of fuel delivery ports 103 through which the highly pressurized fuel in the pressure accumulation chamber 102 is delivered to injectors installed in respective cylinders of the internal combustion engine.

A cylindrical pressure accumulation pipe 104, whose outer circumference is formed in round shape, constitutes the pressure chamber 102. A cylindrical outlet pipe 105, which is connected to the cylindrical pressure accumulation pipe 104, constitutes each of the fuel delivery ports 103. The cylindrical pipe 105 is provided at an outer circumferential surface on a leading end thereof with a male thread portion 106 into which a high-pressure pipe is screwed for fastening.

In the common rail housing 101 of the conventional fuel injection system, the pressure chamber 102 is formed in complete round shape in cross section so that tensile stresses are induced at and concentrated on intersecting portions 107 where the pressure chamber 102 and the respective fuel delivery ports 103 intersect each other. As the fuel injection pressure in the system is higher, the stresses induced at and concentrated on the intersecting portions 107 are larger so that reliability in strength of the common rail housing 101 is likely to be jeopardized. Accordingly, the conventional common rail housing 101 has a drawback on realizing the fuel injection system with much higher pressure.

As a way of solving the drawback, it may be contemplated to reduce an inner diameter of the pressure chamber 102 so that the stresses induced at the intersecting portions 107 become smaller. However, as it is necessary to secure a given inner volume of the pressure chamber 102, which is predetermined for one or more injectors, for a purpose of limiting injection fluctuation of injectors, a longitudinal length of the common rail housing 101 is obliged to be longer so that manufacturing efficiency of the common rail housing 101 and installation efficiency thereof to the internal combustion engine are adversely affected.

As another way of reducing the stresses, JP-A-10-169527 discloses, as shown in FIGS. 7A to 7C, common rail housing 101 having an oval shaped pipe 114 provided with an oval shaped pressure accumulation chamber 113 and also provided with a fuel supply or delivery bore 115 connected to the pressure accumulation chamber 111 at a position where a curvature of the oval is small.

It also describes that the oval shaped pipe 114 having the oval shaped pressure accumulation chamber 113 as shown in FIG. 7B is shaped by plastically deforming a complete round pipe 112 having a pressure accumulation chamber 111 as shown in FIG. 7A with press working or roll forming. In the deformation process, residual stresses (tensile stresses) are induced in the common rail housing 101. Accordingly, stresses ($\alpha$) always remain at the intersecting portion 116 where the fuel input or output bore 115 is connected to the pressure accumulation bore as shown in FIGS. 7B and 7C. Even if the tensile stresses at the intersecting portion, which is induced by inner pressure (P) of highly pressurized fuel in the pressure accumulation chamber 113, is reduced, a sum of the residual stresses ($\alpha$) and the stresses due to the inner pressure (P) is likely to be relatively large so that strength at the intersecting portion 116 is jeopardized.

If wall thickness of the oval shaped pipe 114 is equal to or more than a diameter of the oval pressure accumulation chamber 113 in a minor axis of the oval thereof, that is, if an outer diameter (for example, 30 mm) of the oval shaped pipe 114 in a minor axis length of the oval thereof is larger by three times or more than the diameter (for example, 10 mm) of the oval pressure accumulation chamber 113 in a minor axis of the oval thereof, the strength at the intersecting portion 116 can be sufficiently assured.

However, deformation of the complete round pipe made of iron steel into the oval shaped pipe 114 having such a thick thickness wall needs a several tens or hundreds pressing load. Even if deformed by the press working or the roll forming, as shown in FIGS. 8A and 8B, the oval shaped pipe 114 is likely to have wrinkles or cracks so that pressure endurance of the oval shaped pipe 114 is reduced.

SUMMARY OF THE INVENTION

An object of the invention is to provide a common rail fuel injection system having a common rail housing in which stresses concentrated on given portions are remarkably reduced and, further, resisting pressure strength is distinctively improved.

It is another aspect of the invention to provide a method of manufacturing the common rail housing in which residual stresses induced therein are limited.

To achieve the above objects, the common rail housing is composed of a pressure accumulation pipe, whose outer circumference is formed in roughly complete round shape in cross section, being provided inside with a pressure accumulation chamber having given shaped cross section and extending in a longitudinal direction thereof, and a branch pipe being provided inside with a fuel conduit bore. Outer circumference of the given cross section has a first portion whose curvature is smaller than that of complete round shape having an area equal to that of the given cross section. The branch pipe is connected to the pressure accumulation pipe so that the fuel conduit bore and the pressure accumulation chamber intersect nearly perpendicularly to each other at the first portion.

It is preferable that wall thickness of the pressure accumulation pipe at the first portion is thickest. Therefore, when highly pressurized fuel is supplied to the pressure accumulation chamber, not only the stresses concentrated on the first portion are limited but also wall strength of the pressure accumulation pipe at the first portion is reinforced.

Accordingly, the common rail housing may be made of relatively low hardness material such as low carbon steel that is easily formed in the given shape on manufacturing. Further, as the wall thickness of the pressure accumulation pipe is relatively thick at the first portion and relatively thin at the portions other than the first portion around the circumference of the pressure accumulation chamber, the wall thickness of the pressure accumulation pipe of the present invention is thinner as a whole than the conventional common rail housing, resulting in saving fuel consumption.

It is preferable that the given shaped cross section of the pressure accumulation chamber is formed in roughly flat oval shape or in roughly oval shape.

To limit residual stresses to be induced on manufacturing the common rail housing mentioned above, it is preferable that, after forming a product whose outside configuration is equal to that of the pressure accumulation pipe, the product is drilled at first in a longitudinal direction thereof to form a round hole whose diameter is equal to a minor axis length of the oval in cross section of the pressure accumulation chamber and, then, opposite sides of an inner wall of the round hole are removed in a longitudinal direction thereof by broaching or electrical discharge machining. With the processes, the pressure accumulation chamber having the oval shaped cross section is formed.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

FIG. 7A is a cross sectional view of a conventional pressure accumulation pipe showing original shape as prior art;

FIG. 7B is a cross sectional view of the conventional pressure accumulation pipe deformed to oval shape as prior art;

FIG. 7C is a cross sectional view of the conventional oval pressure accumulation pipe having fuel conduit hole as prior art;

FIG. 8A is a cross sectional view of the conventional pressure accumulation pipe as prior art; and FIG. 8B is an enlarged view of an encircled portion VIII of FIG. 8A.

DETAILED DESCRIPTION OF THE PREFERRED EMBODIMENTS (First Embodiment)

Figure 1:
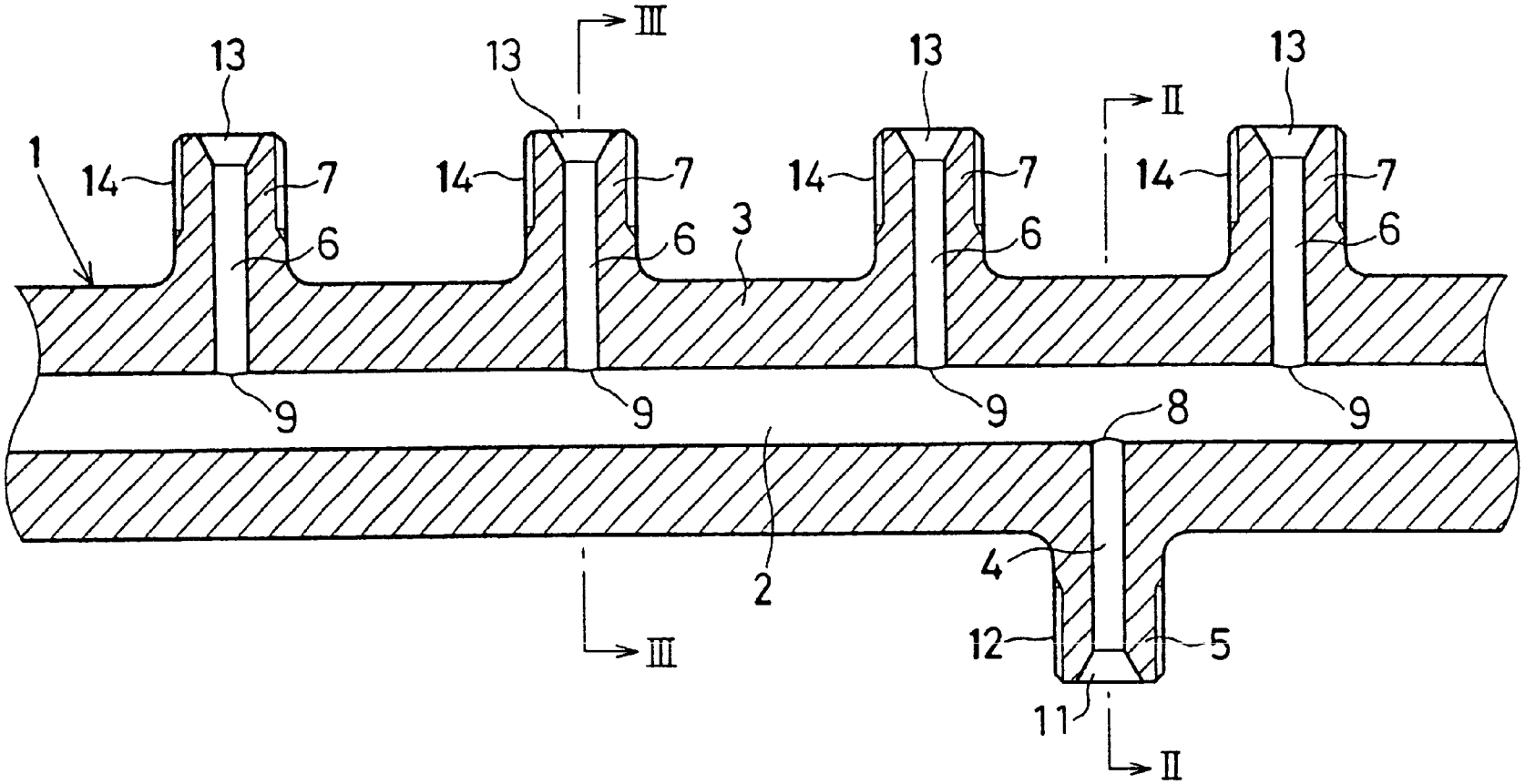
FIG. 1 is a cross sectional view of a common rail housing according to a first embodiment of the present invention.

A common rail fuel injection system according to a first embodiment is described with reference to FIGS. 1 to 3. In the common rail fuel injection system according to the first embodiment, highly pressurized fuel is accumulated in a common rail housing 1 and the fuel accumulated in the common rail housing is injected to respective combustion chambers of a diesel engine through injectors installed in engine cylinders of the respective combustion chambers.

The common rail housing 1, which is a kind of a surge tank, is made of low hardness material such as low carbon steel and is formed in given shape by forging and machining. The common rail housing 1 is a pipe having many branches and is used as a part of the fuel line for the common rail fuel injection system. The common rail housing 1 is composed of a pressure accumulation pipe 3, which constitutes a pressure accumulation chamber 2, an inlet pipe 5, which constitutes a fuel supply bore 4 through which fuel is supplied to the pressure accumulation chamber 2, and outlet pipes 7, which constitute a plurality of fuel delivery bores 6 through which fuel in the pressure accumulation chamber 2 is delivered to injectors (not shown). The number of the fuel delivery bores 6 is equal to that of the injectors.

The pressure accumulation chamber 2 is an inner conduit hole inside the pressure accumulation pipe 3 and stores fuel having relatively high pressure, for example, 20 to 120 Mpa common rail pressure. The inner conduit hole, whose cross section is formed in oval shape having a major axis in right and left directions in FIGS. 2 and 3 and a minor axis in up and down directions therein, extends in a longitudinal direction (in right and left directions in FIG. 1). Further, as shown in FIGS. 2 and 3, an outer circumference of the pressure accumulation pipe 3 is formed in complete round shape in cross section. The pressure accumulation chamber 2 is provided at least at one of longitudinal ends with an opening, which is closed liquid-tightly by a cover (not shown).

The fuel supply bore 4 is connected to the pressure accumulation chamber 2 so as to extend perpendicularly to a longitudinal direction of the pressure accumulation chamber 3. The fuel supply bore 4 is provided at an end (on an upstream side) with a seat face 11 and at another end with an intersecting portion 8. The end of the fuel supply bore 4 is connected to a high-pressure supply pipe (not shown). Fuel is supplied via the high-pressure supply pipe and the fuel supply bore 4 to the pressure accumulation chamber 2 by a fuel supply pump. An end of the high-pressure supply pipe is fitted to the seat face 11 to seal highly pressurized fuel. The intersecting portion 8 is a portion where the pressure accumulation chamber 2 and the fuel supply bore 4 intersect perpendicular to each other. Tensile stresses induced due to internal pressure based on highly pressurized fuel supplied to the pressure accumulation chamber 2 concentrates on the intersecting portion 8.

The inlet pipe 5 is provided on an outer circumference at a leading end thereof (on an upstream side) with a male thread 12 (outer circumferential thread) to which a female thread (inner circumferential thread) provided in a pipe joint (not shown) is screwed. The pipe joint is connected to an end of the high-pressure pipe whose another end is connected to the fuel supply pump. Instead of providing the male thread 12 in the inlet pipe 5 and the female thread in the pipe joint, the male thread may be provided in the pipe joint and the female thread in the inlet pipe.

Each of the fuel delivery bores 6 is connected to the pressure accumulation chamber 2 so as to extend perpendicularly to a longitudinal direction of the pressure accumulation chamber 3. The fuel delivery bore 6 is provided at an end (on a downstream side) with a seat face 13 and at another end with an intersecting portion 9. The end of the fuel delivery bore 6 is connected to a high-pressure delivery pipe (not shown). Fuel is delivered via the fuel delivery bore 6 and the high-pressure delivery pipe to each of the injectors. An end of the high-pressure delivery pipe is fitted to the seat face 13 so as to seal highly pressurized fuel. The intersecting portion 9 is a portion where the pressure accumulation chamber 2 and each of the fuel delivery bores 6 intersect perpendicular to each other. Tensile stresses induced due to internal pressure based on highly pressurized fuel supplied to the pressure accumulation chamber 2 concentrates on the intersecting portion 9.

The outlet pipe 7 is provided on an outer circumference at a leading end thereof (on a downstream side) with a male thread 14 (outer circumferential thread) to which a female thread (inner circumferential thread) provided in another pipe joint (not shown) is screwed. The another pipe joint is connected to an end of the high-pressure delivery pipe whose another end is connected to each of the injectors. Instead of providing the male thread 114 in the outlet pipe 7 and the female thread in the anther pipe joint, the male thread may be provided in the another pipe joint and the female thread in the outlet pipe.

Next, a method of manufacturing the common rail housing 1 is described with reference to FIGS. 1 to 4.

A piece of low hardness material such as low carbon steel is set between a pair of forging dies (upper and lower dies) each having a cavity formed in given shape and is plastically deformed under pressure so that a forging product having given shape is formed. With the forging product, outlines (outside structures) of the pressure accumulation pipe 3 whose cross section is formed in complete round shape, the inlet pipe 5 and the plurality of outlet pipes 7 are completed.

Next, as a first process of forming the oval shaped pressure accumulation chamber 2 in the forging product, a fuel conduit hole 10, whose cross section is complete round and whose diameter is equal to a minor axis length of the oval pressure accumulation chamber 2, is formed by drilling in the forging product in such a manner that a cutting tool such as a drill is rotated and also fed straightly in a direction of a rotating center thereof.

Unless the cross section of the fuel conduit hole 10 formed by drilling is complete round, the fuel conduit hole 10 may be further reamed by another cutting tool such as a reamer so that the fuel conduit hole 10 having highly accurate dimension and fine finishing surface is secured.

Figure 4A:
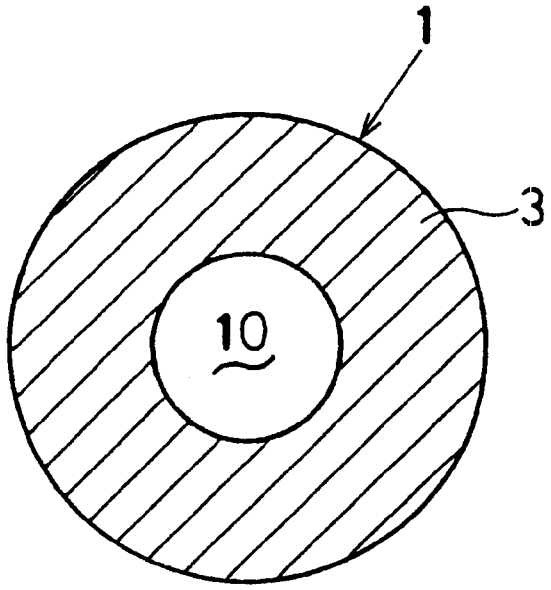
FIG. 4A is a cross sectional view of a forging product at a first manufacturing step according to the first embodiment.
Figure 4B:
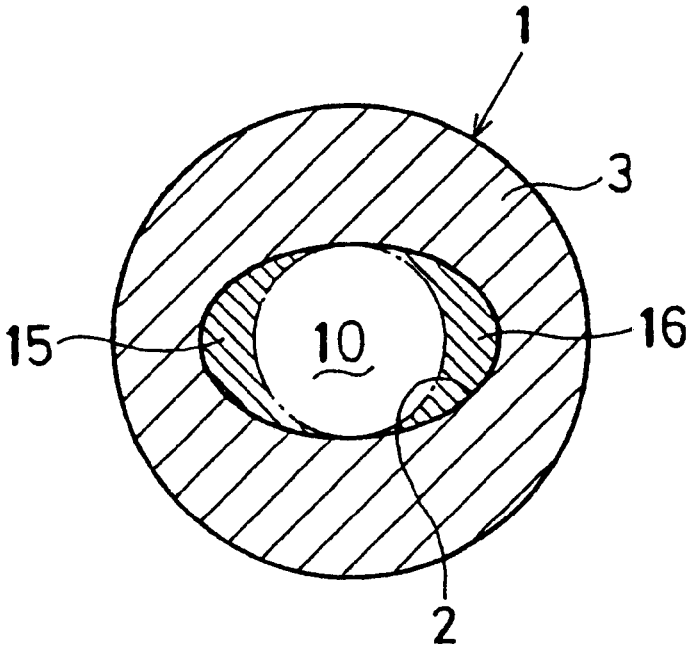
FIG. 4B is a cross sectional view of the forging product at a second manufacturing step according to the first embodiment.

As a second step of forming the oval pressure accumulation chamber 2, as shown in FIG. 4B, portions 15 and 16 of the forging product is removed by broaching or by electrical discharge machining so that the pressure accumulation chamber 2, whose cross section is oval, in the pressure accumulation pipe 3*a* having a complete round outer surface is formed by cutting opposite sides of an inner wall of the complete round fuel conduit hole 10 formed at the first step.

The broaching is executed by moving axially inside the complete round hole 10 a long broach having a plurality of cutting edges arranged in line in a feeding direction thereof. The electrical discharge machining is executed in such a manner that material of the inner wall of the complete round hole 10 in a vicinity of electric discharge points is molten and vaporized by heat generated due to arc of electric discharge in oil.

Further, as the next step, the fuel supply bore and delivery bores 4 and 6, each cross section of which is complete round, in the inlet pipe 5 and the outlet pipes 7 are formed by drilling in the forging product, respectively, in such a manner that a still another cutting tool such as a drill is rotated and also fed straightly in a direction of a rotating center thereof.

The seat faces 11 and 13 are formed by cutting, respectively, so that each end of the fuel supply bore 4 and fuel delivery bores 6 is provided with a conical hole whose inner diameter is gradually larger outward. Next, the male threads 12 and 14 are formed by lathe turning each leading end outer surface of the inlet pipe and outlet pipes 5 and 7 in use of a threading tool. With the fabricating processes mentioned above, the common rail housing 1 as shown in FIGS. 1 to 3 is manufactured.

Instead of forming the forging product at the first step mentioned above, a product having a similar configuration as the forging product may be formed by machining. Further, the adequate configuration of the common rail housing 1 (in the forging or machining product) may be selected so that sufficiently thick wall thickness of the common rail housing 1 at necessary portions is secured without wrinkles and cracks thereon. Accordingly, not only stresses at the intersection portions 8 and 9 due to the oval shape of the pressure accumulation chamber 2 are reduced but also strength at portions adjacent the intersecting. portions 8 and 9 is reinforced.

An operation of the common rail fuel injection system is described with reference to FIGS. 1 to 3.

On operation of the fuel supply pump, highly pressurized fuel is supplied through the fuel supply bore 4 to the pressure accumulation chamber 2. Fuel pressure in the pressure accumulation chamber 2 is kept at a predetermined value and more. The fuel in the pressure accumulation chamber 2 is delivered via the fuel delivery bores 6 to respective fuel storing portions of the injectors. Then, when the injectors open their valves, respectively, highly pressurized fuel in the pressure accumulation chamber 2, the high-pressure delivery pipe and the injectors are injected and supplied to the combustion chamber of the diesel engine.

When the pressure accumulation chamber 2 is filled with highly pressurized fuel supplied by the fuel supply pump, the highly pressurized fuel causes tensile stresses concentrated on the intersecting portion 8 where the fuel supply bore 4 and the pressure accumulation chamber 2 intersect each other at a right angle and on each of the intersecting portions 9 where each of the plural fuel delivery bores 6 and the pressure accumulation chamber 2 intersect each other at a right angle.

According to the embodiment, as the cross section of the pressure accumulation chamber 2 formed by machining is oval and the fuel supply bore 4 and the fuel delivery bores 6 are positioned at places where curvature of oval in cross section of the pressure accumulation chamber 2 is small, the tensile stresses are relatively small.

Figure 2:
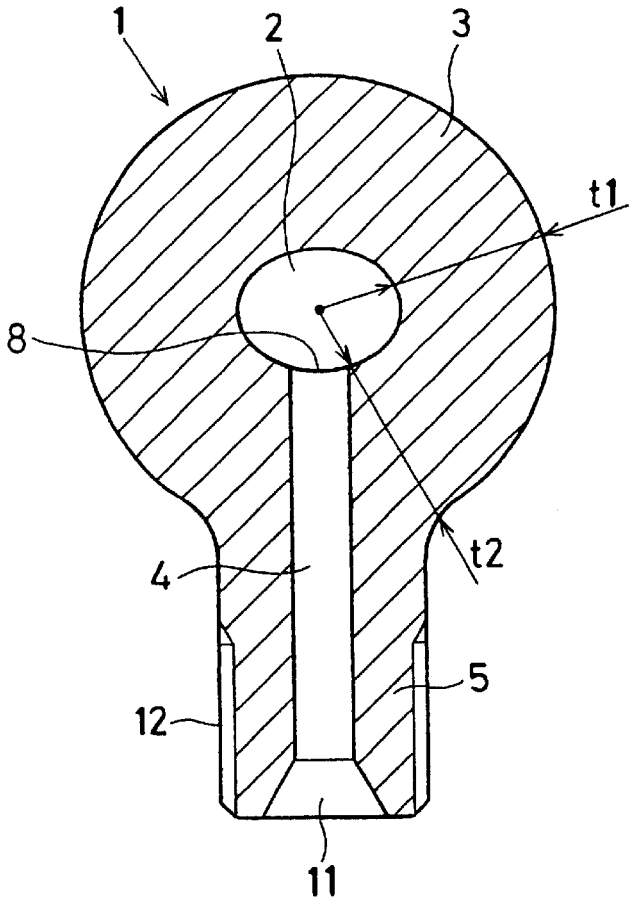
FIG. 2 is a cross sectional view showing a pressure accumulation pipe and an inlet pipe of the common rail housing, which is taken along a line II—II of FIG. 1.
Figure 3:
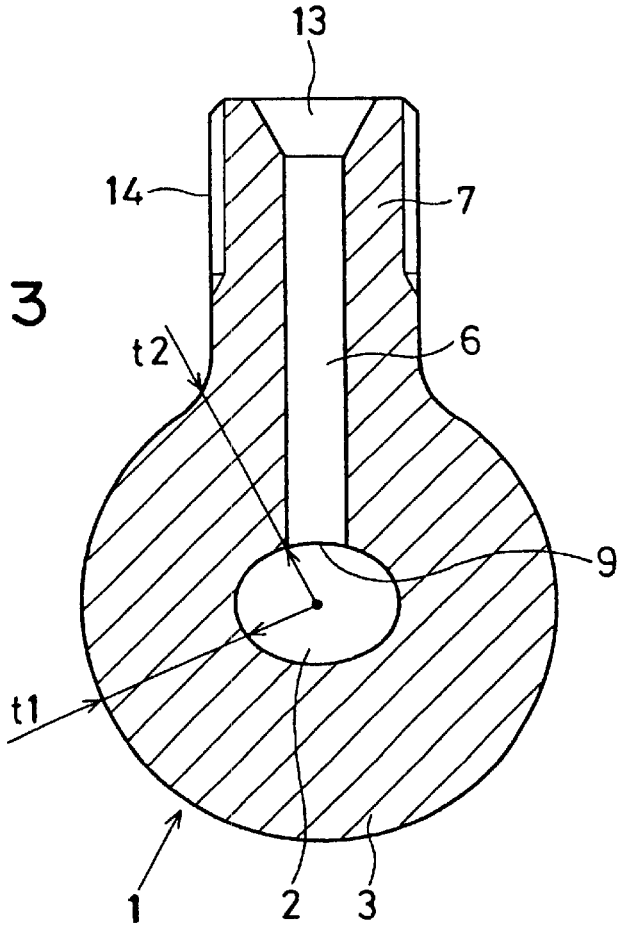
FIG. 3 is a cross sectional view showing a pressure accumulation pipe and an outlet pipe of the common rail housing, which is taken along a line III—III of FIG. 1.

Further, as shown in FIGS. 2 and 3, wall radial thickness (t2) of the pressure accumulation tube 3 at the portion immediately adjacent to each of the intersecting portions 8 and 9 is thicker than that (t1) at the portion not adjacent to each of the intersecting portions 8 and 9.

Accordingly, tensile stresses concentrated on each of the intersecting portions 8 and 9 according to the present invention is smaller than those concentrated on the intersecting portion 107 of the conventional complete round pressure accumulation chamber 102. This may be proved from a theoretical analysis test result.

As a typical example, when the complete round pressure accumulation chamber, whose diameter is 10 mm, having fuel supply and delivery bores, whose each diameter is 4 mm, is compared with the oval pressure accumulation chamber, whose major axis length 11.5 mm and whose minor axis length is 8.5 mm, having fuel supply and delivery bores, whose each diameter is 4 mm, tensile stresses induced at each of the intersecting portions of the oval pressure accumulation chamber is smaller by about 20% than those of the round pressure accumulation chamber.

To reduce the tensile stresses at each of the intersecting portions 8 and 9 as small as possible, it is preferable to position the intersecting portions 8 and 9 on a curved portion whose curvature is much smaller, that is, to form the pressure accumulation chamber 2 having an oval shape whose major axis length is much longer than minor axis length. However, if the curvature of oval on sides of the major axis is too large, the larger tensile stresses concentrate on the large curvature portion on sides of the major axis to an extent that the large curvature portion may be broken. Accordingly, the oval shape of the pressure accumulation chamber 2 is decided by also considering tensile stresses to be concentrated on positions other than the intersecting portions 8 and 9.

As mentioned above, tensile stresses concentrated on the intersecting portions 8 and 9 are remarkably reduced and, further, strength at the wall adjacent the intersecting portions 8 and 9 are distinctively reinforced so that it is allowed to endure higher fuel injection pressure in the common rail fuel injection system.

As a cross section area of the oval pressure accumulation chamber 2 according to the first embodiment is equal to that of the conventional complete round pressure accumulation chamber, a longitudinal total length of the common rail housing is same as that of the conventional common rail housing. Accordingly, it is not necessary to make a body of the common rail housing larger, even if the strength thereof is much more reinforced, compared with the conventional common rail housing.

Further, since the tensile stresses concentrated on the intersecting portions 8 and 9 is reduced, an entire wall thickness of the pressure accumulation pipe 3 is thinner, compared with the conventional accumulation pipe. As a result, a lightweight common rail housing may be realized, resulting in less fuel consumption.

Furthermore, as the common rail housing 1 is provided with the pressure accumulation tube 3 and the inlet and outlet pipes 5 and 7 that are integrated into one body, strength of the common rail housing 1 is stronger. Moreover, as the common rail housing 1 is made of low hardness material such as low carbon steel and the pressure accumulation chamber 2 is formed to the complete round shape by drilling and, then, to the oval shape by broaching or electrical discharge machining, residual stresses in the pressure accumulation pipe 3 are limited, compared with the conventional pressure accumulation pipe having the oval pressure accumulation chamber, into which the complete round accumulation pipe is shaped by press working or roll forming.

If residual stresses ($\alpha$) remain at the intersecting portions due to the press working or the roll forming, both of stresses induced by internal pressure (P) of the highly pressurized fuel and the residual stresses ($\alpha$) are adversely affected on the intersecting portions.

(Second Embodiment)

Figure 5:
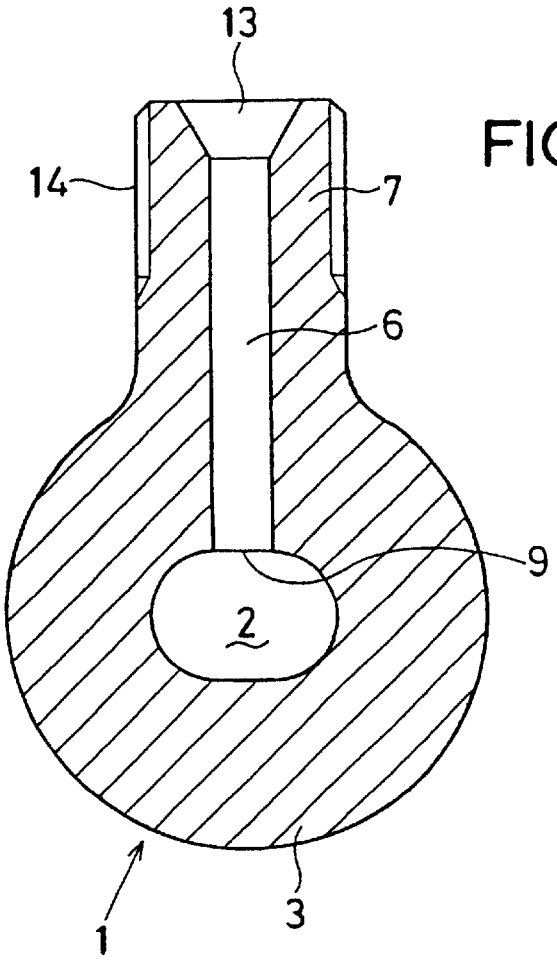
FIG. 5 is a cross sectional view showing a pressure accumulation pipe and an outlet pipe of a common rail housing according to a second embodiment of the present invention.
Figure 6:
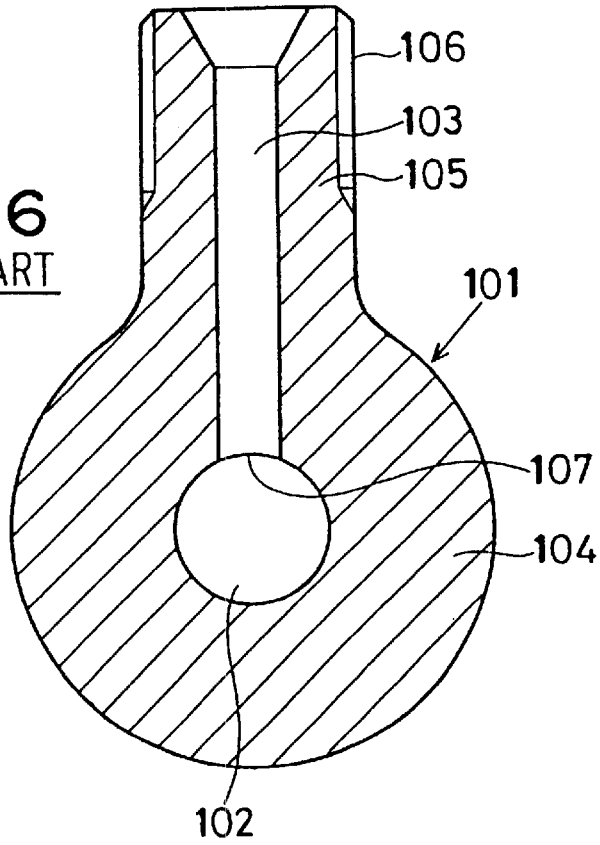
FIG. 6 PRIOR ART
FIG. 6 is a cross sectional view showing a pressure accumulation pipe and an outlet pipe of a conventional common rail housing as prior art.

A common rail housing according to a second embodiment is described with reference to FIG. 5.

According to the second embodiment, the cross section of the pressure accumulation chamber is formed in flat oval shape and each of the fuel supply and delivery bores 4 and 6 is connected to the pressure accumulation chamber 2 at a position where curvature of the flat oval is small, that is, at a straight line position of the flat oval.

As each of the fuel supply and delivery bores 4 and 6 and the pressure accumulation bore 2 intersect each other at the largest curvature position, tensile stresses induced on each of the intersecting portions 8 and 9 are more reduced, compared with those of the conventional complete round pipe 104.

The cross section of the pressure accumulation chamber 2 is not limited to the oval shape or the flat oval shape and may be any shape, as far as the intersecting portions 8 and 9 are formed at positions where the curvature of wall of the pressure accumulation chamber is relatively small. Further, it is preferable that a corner where each of the fuel supply and delivery bores 4 and 6 and the pressure accumulation chamber 2 intersect each other is rounded.

Though the present invention is applied to the common rail housing, a gist of the invention is also applicable to any other devices or constructions where a pressure accumulation chamber, to which high pressure is applied, and an input or output bore, from which high pressure is supplied or delivered, intersect each other, for example, the construction where a sensoror pipe such as a fuel pressure sensor or a connector and the pressure accumulation chamber.

Further, instead of the single input pipe 5 having the single fuel supply bore 4 as mentioned above, a plurality of input pipes 5, each of which has a single fuel supply bore 4, may be provided, or the single input pipe 5 may have a plurality of fuel supply bores 4.

Furthermore, instead of the plural output pipe 7 each having the single fuel delivery bore 6 as mentioned above, a single output pipe 7 having a single fuel delivery bore 6 may be provided, or the single out pipe 5 may have a plurality of fuel delivery bores 6.

What is claimed is:

1. A common rail fuel injection system having a common rail housing, the common rail housing comprising:

a pressure accumulation pipe, whose outer circumference is formed in roughly complete round shape in cross section, being provided inside with a pressure accumulation chamber having given shaped cross section and extending in a longitudinal direction thereof, outer circumference of the given cross section having a first portion whose curvature is smaller than that of complete round shape having an area equal to that of the given cross section; and a branch pipe protruding partly outward from the pressure accumulation pipe and being provided inside with a fuel conduit bore, wherein the branch pipe and the pressure accumulation pipe are an integrated one piece construction and the fuel conduit bore and the pressure accumulation chamber intersect nearly perpendicularly to each other at the first portion.

2. A common rail fuel injection system according to claim 1, wherein wall thickness of the pressure accumulation pipe is thickest at the first portion.

3. A common rail fuel injection system according to claim 1, wherein the given shaped cross section of the pressure accumulation chamber is formed in roughly flat oval shape.

4. A common rail fuel injection system according to claim 1, wherein the given shaped cross section of the pressure accumulation chamber is formed in roughly oval shape.

5. A common rail fuel injection system according to claim 4, wherein a method of manufacturing the common rail housing comprises steps of:

forming a product whose outside configuration is equal to that of the pressure accumulation pipe;

drilling a round hole in the product in a longitudinal direction thereof, diameter of the round hole being equal to a minor axis length of the oval in cross section of the pressure accumulation chamber; and removing opposite sides of an inner wall of the round hole in a longitudinal direction thereof by one of ways of broaching and electrical discharge machining so that the pressure accumulation chamber having the oval shaped cross section is formed.

* * * * *